US007522129B2

(12) United States Patent
Kanazawa et al.

(10) Patent No.: US 7,522,129 B2
(45) Date of Patent: Apr. 21, 2009

(54) PLASMA DISPLAY DEVICE

(75) Inventors: Yoshikazu Kanazawa, Kawasaki (JP); Shigetoshi Tomio, Yokohama (JP); Takashi Fujisaki, Kawasaki (JP)

(73) Assignee: Fujitsu Hitachi Plasma Display Limited, Miyazaki-ken (JP)

( * ) Notice: Subject to any disclaimer, the term of this patent is extended or adjusted under 35 U.S.C. 154(b) by 301 days.

(21) Appl. No.: 11/387,907

(22) Filed: Mar. 24, 2006

(65) Prior Publication Data

US 2006/0214090 A1 Sep. 28, 2006

(30) Foreign Application Priority Data

Mar. 25, 2005 (JP) ..... 2005-088799

(51) Int. Cl.
*G09G 3/28* (2006.01)

(52) U.S. Cl. ..... 345/60; 345/69; 345/63; 315/169.4

(58) Field of Classification Search ..... 345/60–72, 345/209–211; 315/169.4
See application file for complete search history.

(56) References Cited

U.S. PATENT DOCUMENTS 5,446,344 A * 8/1995 Kanazawa ..... 315/169.4
6,400,344 B1 * 6/2002 Tsunoda et al. ..... 345/60
6,686,912 B1 2/2004 Kishi et al.
6,781,322 B2 * 8/2004 Onozawa et al. ..... 315/169.3
2002/0097237 A1 * 7/2002 Tomio et al. ..... 345/211
2004/0085262 A1 5/2004 Lee
2004/0178741 A1 * 9/2004 Masumura ..... 315/167
2004/0207333 A1 * 10/2004 Matsumoto ..... 315/169.4

FOREIGN PATENT DOCUMENTS

KR 2001-7548 1/2001

* cited by examiner

*Primary Examiner*—Richard Hjerpe
*Assistant Examiner*—Jason M Mandeville
(74) *Attorney, Agent, or Firm*—Antonelli, Terry, Stout & Kraus, LLP.

(57) ABSTRACT

An electrode drive circuit of a plasma display device comprises: a scan driver provided with plural drivers including first and second switching elements and first and second diodes; a capacitor connected between the high potential side terminal and the low potential side terminal of the scan driver; a voltage supply circuit for selectively supplying plural voltages relating to the positive and negative voltages of the reset pulse and the voltage of a scan pulse to the low potential side terminal of the second switching element; and a negative reset switch and a resistor connected in series between the high potential side terminal of the first switching element and a ground terminal, wherein the reset pulse of negative polarity is applied by turning on the negative reset switch in a state where the capacitor is charged with the negative voltage of the reset pulse.

5 Claims, 7 Drawing Sheets

PLASMA DISPLAY DEVICE

CROSS-REFERENCE TO RELATED APPLICATION

The present application claims priority from Japanese Patent Application No. JP 2005-088799 filed on Mar. 25, 2005, the content of which is hereby incorporated by reference into this application.

TECHNICAL FIELD OF THE INVENTION

The present invention relates to a plasma display device. More particularly, it relates to a drive circuit of electrodes to which scan pulses are applied in the plasma display device.

BACKGROUND OF THE INVENTION

FIG. 1 is a diagram showing the entire structure of a plasma display device (PDP device). A reference numeral 10 denotes a plasma display panel (PDP). While there are various types of PDPs, any type of the PDP has at least two or more sets of plural electrodes arranged in parallel, and scan pulses are sequentially applied to a set of plural electrodes. The present invention relates to the drive circuit for driving plural electrodes to which scan pulses are applied. In the following description, a triple-electrode type PDP device of an address/display separation method which is now widely used will be described as an example.

In the PDP 10, a first substrate and a second substrate are attached to each other and discharge gas is injected therebetween. On the first substrate, a plurality of first (X) electrodes and a plurality of second (Y) electrodes are alternately arranged in parallel to each other, which are covered with a dielectric layer. On the second substrate, a plurality of address (A) electrodes are arranged in parallel to each other in the direction perpendicular to the X and Y electrodes, barrier ribs are provided between the address electrodes, and phosphors are coated on the address electrodes and the side surfaces of the barrier ribs. Display cells C are formed at the positions where the X and Y electrodes intersect the address electrodes.

The display is performed by applying a high voltage to each electrode to generate a discharge between the electrodes. For this reason, the PDP device is provided with an X electrode drive circuit 11 for applying the voltage to the X electrodes, and a Y electrode drive circuit 12 for applying the voltage to the Y electrodes, and an address electrode drive circuit 13 for applying the voltage to the address electrodes.

In the PDP device, only the on/off control whether the light is emitted or not can be performed, and it is difficult to control luminous intensity. Hence, in order to perform a grayscale display, one display frame is divided into a plurality of sub-fields, and the grayscale display is performed by combining the sub-fields to be lit.

FIG. 2 is a diagram showing an example of driving waveforms applied to each electrode in one sub-field in the PDP device of FIG. 1. Each sub-field has basically the same sequence, but is different in the length of sustain discharge period and the number of sustain pulses applied in the sustain discharge period.

As shown in FIG. 2, the sub-field includes a reset period in which all the cells are brought into a uniform state, an address period in which the cells to be turned on are selected, and the sustain discharge period in which the selected cells are turned on.

In the reset period, 0 V is applied to the address electrodes and a positive voltage +Vs is applied to the Y electrodes. In this state, the voltage gradually lowering from 0 V to a negative voltage is applied to the X electrodes. Thereafter, in the state where the negative voltage is applied to the X electrodes, the voltage increasing from the positive voltage to Vw is applied to the Y electrodes. In this manner, a wall charge is formed on the dielectric layers of all the cells. This operation is referred to as a reset write, and the voltage increasing from the positive voltage to Vw which is applied to the Y electrodes is referred to as a reset write pulse. Then, after the voltage +Vs is applied to the X electrodes and the voltage applied to the Y electrodes is set to 0V, the voltage gradually decreasing to −Vs is applied to the Y electrodes. Accordingly, the wall charges formed in all the cells are almost erased. This operation is referred to as a reset erase, and the voltage gradually lowering from 0 V to −Vs, which is applied to the Y electrodes, is referred to as a reset erase pulse. Note that the final voltage of the reset erase pulse (in this case, −Vs) relates to the amount of residual wall charge. Since the voltage to be applied for the next address discharge can be decreased by leaving some amount of wall charges, the final voltage of the reset erase pulse is appropriately set.

In the address period, in the state where the voltage +Vs is applied to the X electrodes and a voltage Vsc is applied to the Y electrodes, the scan pulse of a voltage −Vy is sequentially applied to the Y electrodes, and the address pulse of a voltage Va is applied to the address electrodes of the cells to be turned on in accordance with the application of the scan pulses. By doing so, address discharges are generated between the Y electrodes and the address electrodes of the cells to which the scan pulse and the address pulse are applied at the same time, and the discharge acts as a trigger to generate the address discharges between the X electrodes and the Y electrodes of the cells. Accordingly, negative wall charges are formed on the dielectric layer of the X electrodes, and positive wall charges are formed on the dielectric layer of the Y electrodes. The wall charge is not formed in the cell in which the address discharge is not generated. When the scan pulses are sequentially applied to all the Y electrodes to perform such an operation, the cells to be turned on are selected from all the cells.

In the sustain discharge period, first, when the sustain pulse of −Vs is applied to the X electrodes and the sustain pulse of +Vs is applied to the Y electrodes, the voltage by the wall charge is superposed to generate the sustain discharge in the cells where the address discharge has been generated, and a positive wall charge is formed on the dielectric layer of the X electrodes and a negative wall charge is formed on the dielectric layer of the Y electrodes, thereby completing the initial sustain discharge. Since the wall charge is not formed in the cell where the address discharge is not generated, the sustain discharge is not generated. Next, when the sustain pulse of +Vs is applied to the X electrodes and the sustain pulse of −Vs is applied to the Y electrodes, the voltage by the wall charge is superposed to generate the sustain discharge in the cell where the previous sustain discharge is generated, and a negative wall charge is formed on the dielectric layer of the X electrodes, and a positive wall charge is formed on the dielectric layer of the Y electrodes. Subsequently, by applying the sustain pulses to the X electrodes and the Y electrodes while changing the polarity, the sustain discharge is continued.

In the driving waveforms shown in FIG. 2, the positive and negative voltages are applied to the X electrode and the Y electrode. Before the use of the driving waveforms shown in FIG. 2 was started, the sustain pulse of 2Vs was applied to only one of the X electrode and the Y electrode to generate the sustain discharge. For example, when Vs is 90 V, 2Vs is 180 V. To realize a power supply circuit capable of generating such a high voltage, it is necessary to use a driving element with a high withstand voltage on the other hand, when the driving waveforms shown in FIG. 2 are used, the size of the power supply circuit can be reduced.

Further, in the driving waveforms shown in FIG. 2, in the reset period, the pulses in which the voltage gradually changes are applied to the X electrodes and the Y electrodes. Before the use of the driving waveforms shown in FIG. 2 was started, the pulses in which the voltage rapidly changes were applied. Consequently, a large discharge was generated in all the cells in the reset period, and as a result, all the cells emitted light with high intensity and the display contrast was degraded. Meanwhile, if the driving waveforms shown in FIG. 2 are used, the intensity of the discharge generated in all the cells in the reset period can be reduced, and the display contrast can be enhanced.

As described above, since the same voltage is always applied to the X electrodes, the X electrode drive circuit 11 drives all the X electrodes in common. On the other hand, since the scan pulses have to be separately applied to the Y electrodes, the Y electrode drive circuit 12 is provided with a scan driver for applying the voltage separately to each Y electrode and a circuit for supplying various voltages to the power supply terminals of the scan driver. Similarly, since the voltage has to be individually applied to each address electrode, the address electrode drive circuit 13 is provided with a parallel driver for individually applying the voltage to each address electrode and a circuit for supplying a predetermined voltage to the power supply terminals of the parallel driver.

As described above, the present invention relates to the drive circuit of the electrodes to which the scan pulses are applied. More specifically, it relates to the improvement of the Y electrode drive circuit.

FIG. 3 is a diagram showing the structure of the Y electrode drive circuit 12 which applies the voltage to the Y electrodes in accordance with the driving waveforms of FIG. 2 in the PDP device of FIG. 1. The part denoted by a reference character Sn is a part of the scan driver, which corresponds to a sub-driver for driving one Y electrode. The scan driver is provided with as many sub-drivers as the Y electrodes to be driven, and the high potential side power supply terminals VDH and the low potential side power supply terminals VDL of all the sub-drivers are connected in common, respectively. The other portions of FIG. 3 supply the voltage in accordance with the operation to the high potential side power supply terminals VDH and the low potential side power supply terminals VDL of the sub-drivers in common.

More specifically, the sub-driver Sn has first and second switching elements SW1 and SW2 connected in series, a first diode D1 connected in parallel with the first switching element SW1, and a second diode D2 connected in parallel with the second switching element SW2. The low potential side power supply terminal of the first switching element SW1 and the high potential side power supply terminal of the second switching element SW2 are connected to each other and the connecting node thereof is connected to each Y electrode. The high potential side power supply terminal VDH of the first switching element SW1 is connected to the high potential side power supply terminal VDH of the first switching element SW1 of other sub-drivers in common. Further, the low potential side power supply terminal VDL of the second switching element SW2 is connected to the low potential side power supply terminal VDL of the second switching element SW2 of other sub-drivers in common. In the description below, the high potential side power supply terminal VDH of the first switching element SW1 of the sub-driver Sn is referred to as a high potential side power supply terminal VDH of a sub-driver, and the low potential side power supply terminal VDL of the second switching element SW2 of the sub-driver Sn is referred to as a low potential side power supply terminal VDL of a sub-driver.

The high potential side power supply terminal VDH of a sub-driver is connected to the power supply of the voltage Vsc.

The low potential side power supply terminal VDL of a sub-driver is connected to the power supply of the voltage +Vs via a switch SW3 and a diode D3. The connecting node between the switch SW3 and the diode D3 is connected to the ground GND via a capacitor C1 and a switch SW6. The connecting node between the capacitor C1 and the switch SW6 is connected to the power supply of a voltage Vs via a switch SW5 and a resistor R1.

The low potential side power supply terminal VDL of a sub-driver is connected to the power supply of the voltage −Vs via a switch SW4 and a diode D4. A switch SW9 and a resistor R2 connected in series are provided in parallel with the switch SW4. The connecting node between the switch SW4 and the diode D4 is connected to the ground GND via a capacitor C3 and a switch SW8. The connecting node between the capacitor C3 and the switch SW8 is connected to the power supply of a voltage V2 via a capacitor C2 and a switch SW7. The connecting node between the capacitor C2 and the switch SW7 is connected to the ground GND via a switch SW10.

Switches SW1 to SW10 are realized by power MOSFETs, IGBTs and the like.

Hereinafter, the operation at the time of applying the driving waveforms of FIG. 2 by a conventional Y electrode drive circuit 12 of FIG. 3 will be described.

When applying reset write pulses in the reset period, the switch SW6 is turned on and the capacitor C1 is charged with the voltage Vs (90V). Thereafter, in the state where the switch SW6 is turned off, the switches SW3 and SW5 are turned on. In this manner, the voltage of one terminal of the capacitor C1 changes from the GND to V1 (210V), and therefore, the voltage of one terminal of the capacitor C1 is increased to V1+Vs (210V+90V=300V), and the voltage V1+Vs is supplied to the Y electrode Yn via the switch SW3 and the diode D2. The dotted line in FIG. 3 shows a current path at this time. Since the current path is provided with the resistor R1, the voltage of Y electrode Yn gradually increases.

FIG. 4 shows the current path at the time of applying the reset erase pulse. When the reset erase pulse is applied, the switches SW2 and SW9 are turned on. In this manner, the Y electrode Yn is connected to the power supply of the voltage −Vs via the switches SW2 and SW9 and the diode D4. Since the current path is provided with the resistor R2, the voltage of the Y electrode Yn gradually decreases. At this time, the switches SW7 and SW8 are kept turned on.

In the reset period, the capacitor C2 is charged with the voltage V2, and the capacitor C3 is charged with the voltage Vs. When the switches SW7 and SW8 are turned off and the switch SW10 is turned on in the address period, the voltage of the connecting node between the switch SW4 and the capacitor C3 becomes −Vy (−(V2+Vs)). When the switches SW3 and SW9 are turned off and the switch SW4 is turned on, the voltage −Vy is supplied to the low potential side power supply terminal VDL of a sub-driver. The voltage Vsc is supplied to the high potential side power supply terminal VDH of a sub-driver. When the scan pulse is not applied, the switch SW1 is turned on and the switch SW2 is turned off, and when the scan pulse is applied, the switch SW1 is turned off and the switch SW2 is turned on.

In the sustain period, in the state where the switches SW2, SW6 and SW8 are turned on, the switches SW3 and SW4 are alternately turned on, thereby alternately supplying the voltages +Vs and −Vs.

SUMMARY OF THE INVENTION

In the conventional Y electrode drive circuit of FIG. 3 and FIG. 4, the switch SW9 is formed of a power MOSFET or IGBT, and it is necessary to set the reference voltage of the operation at −Vs. A control signal for each switch outputted from a control circuit is a signal of a ground reference. Hence, a drive circuit for operating the switch SW9 is required to receive a signal of the ground reference and output a signal of −Vs reference. This holds true with the switches SW1 to SW4. Therefore, the drive circuit of the switch SW9 has to have a level conversion circuit for converting the signal of the ground reference into the signal of −Vs reference or have a photocoupler and the like, and thus, this is an expensive circuit.

Further, in the conventional Y electrode drive circuit of FIG. 3 and FIG. 4, there has been a problem that it is necessary to supply a voltage V1 of 210V, which makes the power supply circuit for supplying the voltage V1 expensive.

An object of the present invention is to reduce the cost of the Y electrode drive circuit and the power supply circuit in a PDP device.

In order to achieve the above-described object, in the plasma display device of a first aspect of the present invention, a capacitor is connected between the high potential side power supply terminal VDH and the low potential side power supply terminal VDL of a sub-driver, and the switch SW9 through which the current of the reset erase pulse flows in the conventional circuit is removed, and a switch corresponding to the switch SW9 is provided between the high potential side power supply terminal VDH of the sub-driver and the ground terminal.

More specifically, the plasma display device of a first aspect of the present invention is a plasma display device comprising an electrode drive circuit for applying a scan pulse of negative polarity, a sustain pulse, and reset pulses of positive and negative polarities to electrodes of a plasma display panel, wherein the electrode drive circuit comprises:

a scan driver in which a plurality of drivers including first and second switching elements connected in series, a first diode connected in parallel with the first switching element, and a second diode connected in parallel with the second switching element are provided, and a connecting node between a low potential side terminal of the first switching element and a high potential side terminal of the second switching element of each driver is connected to each first electrode;

a capacitor connected between the high potential side terminal of the first switching element and the low potential side terminal of the second switching element;

a voltage supply circuit for selectively supplying plural voltages relating to the voltages of positive and negative polarities of the reset pulse and the voltage of the scan pulse to the low potential side terminal of the second switching element; and a negative reset switch and a resistor connected in series between the high potential side terminal of the first switching element and the ground terminal, and the reset pulse of a negative polarity is applied by turning on the negative reset switch so as to connect the high potential side terminal of the first switching element to the ground terminal in a state where the negative voltage of the reset pulse is charged to the capacitor.

In the plasma display device of a first aspect of the present invention, since the switch through which the current of the reset erase pulse flows is provided between the high potential side power supply terminal VDH of the first switching element (sub-driver) and the ground terminal, this switch is operated by the ground reference, and the structure of the driver circuit of this switch is simplified. Therefore, it is possible to reduce the cost.

It is desirable that a constant voltage diode is provided between the negative reset switch and the high potential side terminal of the sub-driver. By doing so, the final voltage of the reset pulse of negative polarity can be set by the voltage value of the constant voltage diode.

In a plasma display device of the second aspect of the present invention, a capacitor is connected between the high potential side power supply terminal VDH and the low potential side power supply terminal VDL of the sub-driver, and after applying the reset write pulse through the same path as the conventional circuit, the first switching element is turned on, and the voltage obtained by superposing the voltage charged in the capacitor on the voltage of the reset write pulse is applied to the electrode via the first switching element.

More specifically, the plasma display device of the second aspect of the present invention is a plasma display device comprising an electrode drive circuit for applying a scan pulse of negative polarity, a sustain pulse, and reset pulses of positive and negative polarities to electrodes of a plasma display panel, wherein the electrode drive circuit comprises:

a scan driver in which a plurality of drivers including first and second switching elements connected in series, a first diode connected in parallel with the first switching element, and a second diode connected in parallel with the second switching element are provided, and a connecting node between a low potential side terminal of the first switching element and a high potential side terminal of the second switching element of each driver is connected to each first electrode;

a capacitor connected between the high potential side terminal of the first switching element and the low potential side terminal of the second switching element; and a voltage supply circuit for selectively supplying plural voltages relating to the voltages of positive and negative polarities of the reset pulse and the voltage of the scan pulse to the low potential side terminal of the second switching element, the voltage supply circuit has a resistor in a path for supplying a low reset voltage, after the capacitor is charged with the negative voltage of the sustain pulse, in a state where the voltage supply circuit supplies a low reset voltage lower than the positive voltage of the reset pulse to the low potential side terminal of the second switching element, the reset pulse of positive polarity is applied in two steps of a first step and a second step, in the first step, the second switching element is turned on and the low reset voltage is applied to the electrodes, and in the second step, after the second switching element is turned off, the first switching element is turned on, and the voltage of the capacitor is superposed on the low reset voltage and then applied to the electrodes.

According to the present invention, in the first step, a low reset voltage is applied through the same path as the conventional example, and in the second step, the voltage obtained by superposing the voltage charged in the capacitor on the low reset voltage is applied to the electrode via the first switching element. In this manner, even though the low reset voltage lower than the conventional one is supplied, the same reset write voltage as the conventional example can be applied to the electrodes.

According to the first aspect of the present invention, since the switch through which the current of the reset erase pulse flows is operated by the ground reference, the structure of the driver circuit is simplified and the cost can be reduced.

According to the second aspect of the present invention, even though the low reset voltage lower than the conventional example is supplied, the same reset write voltage as the conventional example can be applied to the electrodes, and thus the cost of the power supply circuit can be reduced.

BRIEF DESCRIPTIONS OF THE DRAWINGS

DESCRIPTIONS OF THE PREFERRED EMBODIMENTS

Hereinafter, a PDP device of an embodiment of the present invention will be described. The PDP device of this embodiment is different from the conventional example only in the structure of a Y electrode drive circuit, and it has the same structure as the conventional example in other portions.

Figure 1:
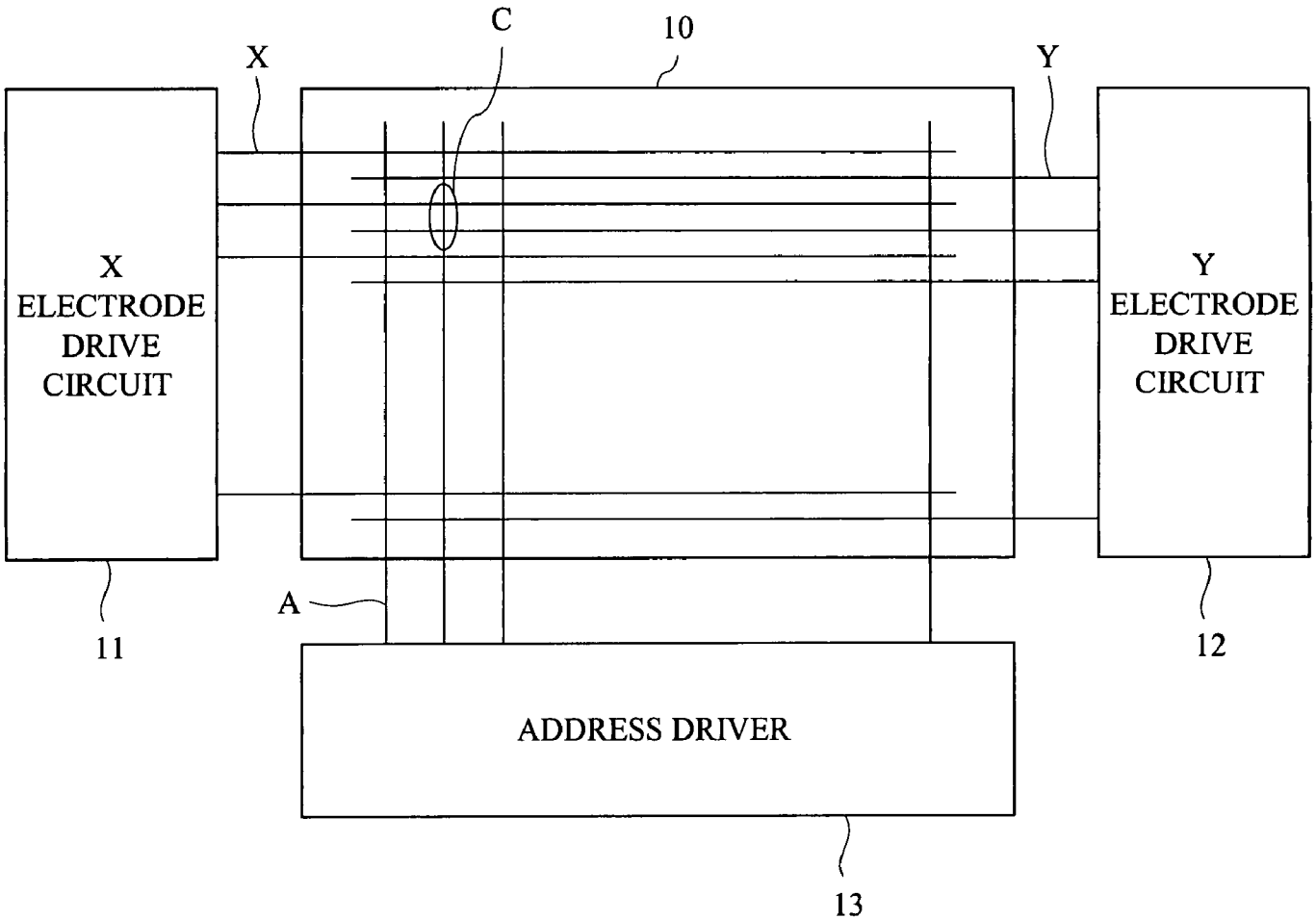
FIG. 1 is a diagram showing the entire structure of a plasma display (PDP) device.
Figure 2:
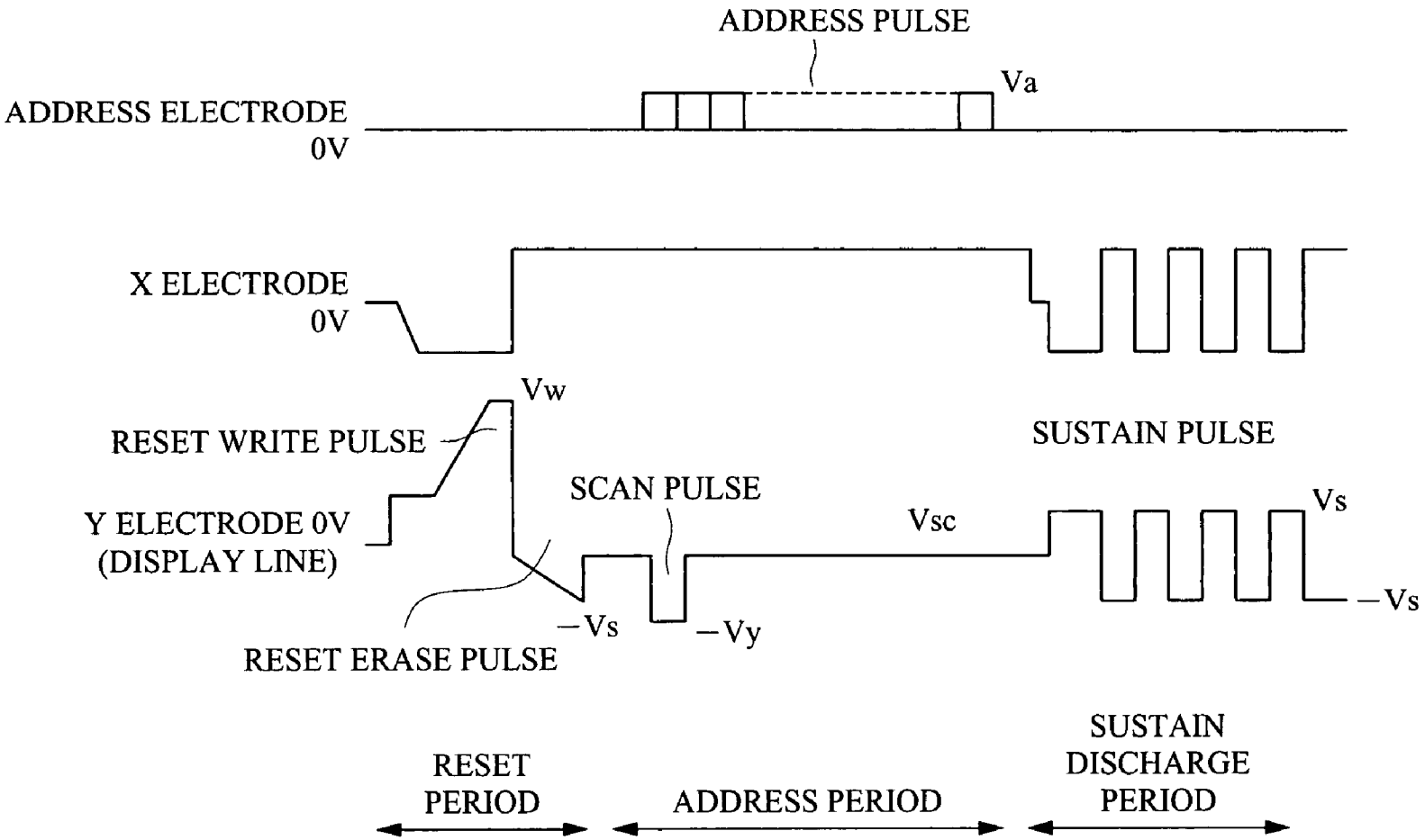
FIG. 2 is a diagram showing driving waveforms in the PDP device.
Figure 3:
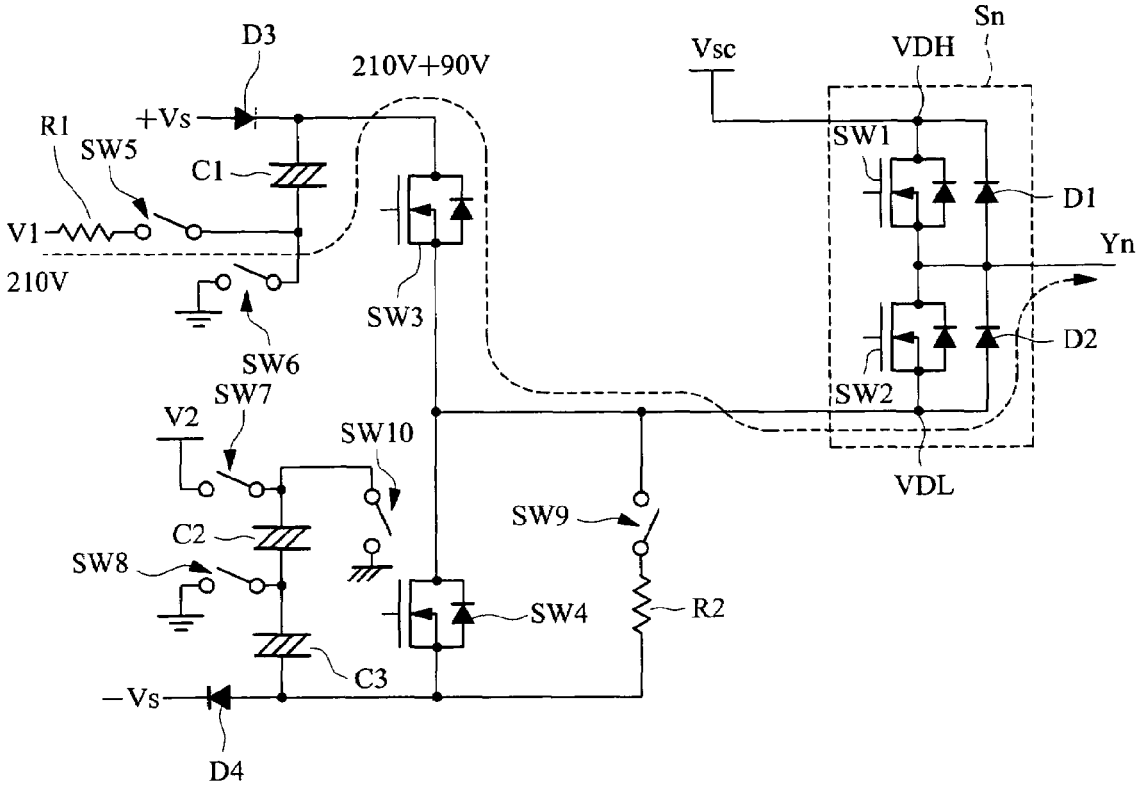
FIG. 3 is a diagram showing the structure of a conventional drive circuit.
Figure 4:
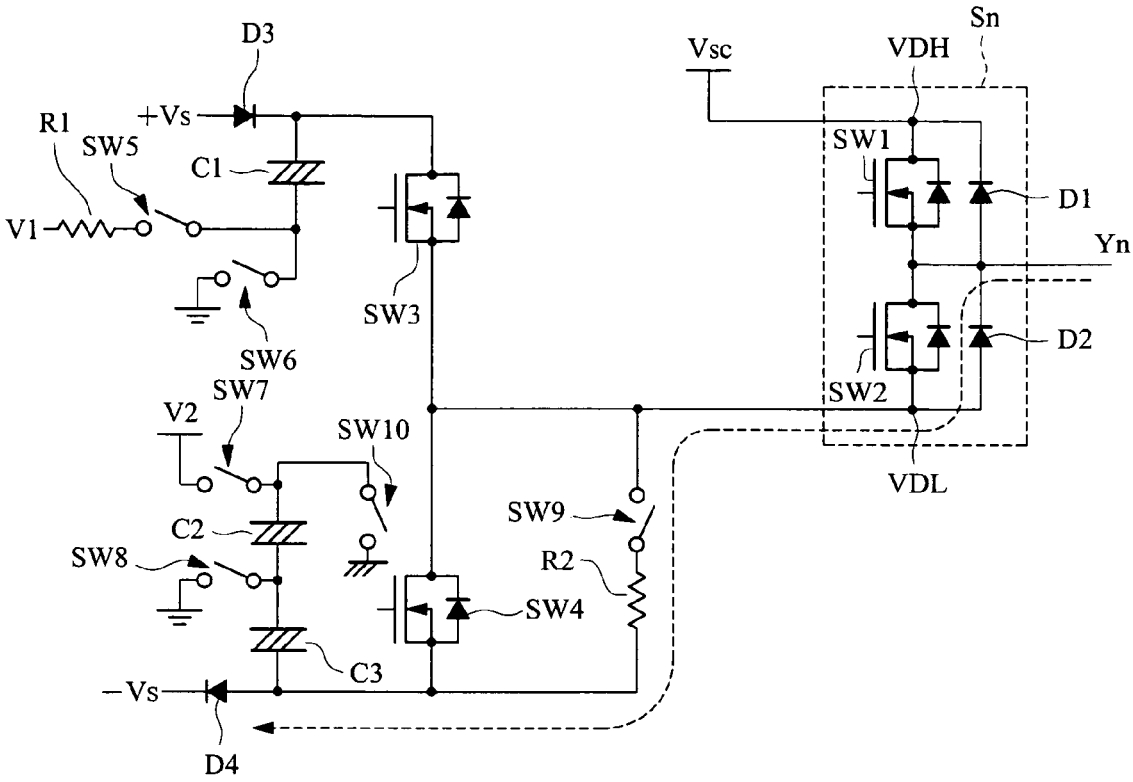
FIG. 4 is a diagram showing a current path in the conventional drive circuit.
Figure 5:
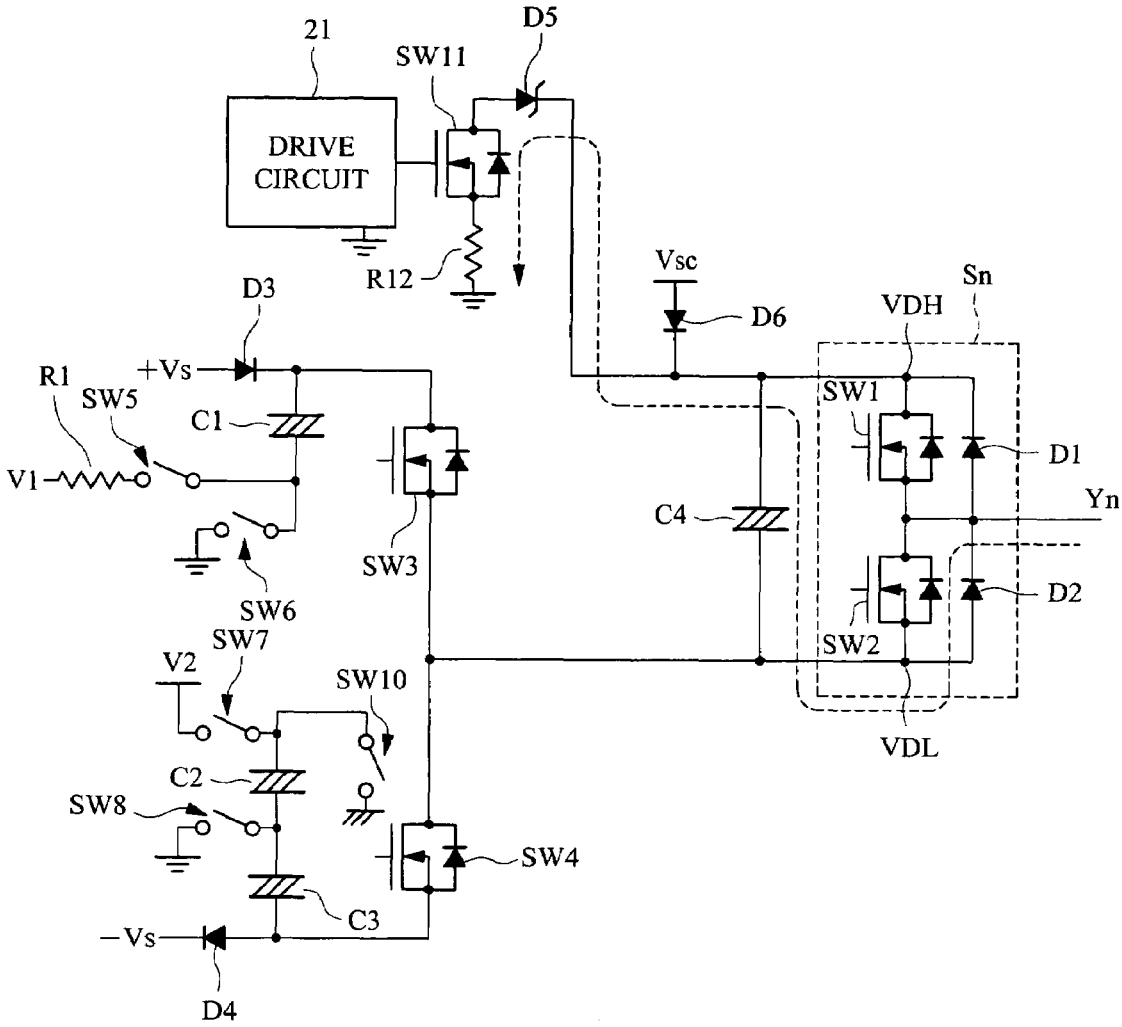
FIG. 5 is a diagram showing the structure of the drive circuit of the PDP device according to an embodiment of the present invention.

FIG. 5 is a diagram showing the structure of the Y electrode drive circuit in the PDP device according to an embodiment of the present invention. As is evident from the comparison with FIG. 3, the Y electrode driver circuit is different from that of the conventional example in that a capacitor 4 is connected between the high potential side terminal VDH and the low potential side terminal VDL of the sub-driver Sn, a switch SW9 which is turned on when applying a reset erase pulse and a resistor R2 which is connected in series to the switch SW9 are removed, and a zener diode D5, a switch SW11, and a resistor R12 are connected in series between the high potential side terminal VDH and the ground GND of the sub-driver Sn. The switch SW11 is driven by a drive circuit 21. Hereinafter, only the points different from the conventional example will be described.

In the circuit of FIG. 5, a switch SW4 is turned on before applying the reset erase pulse. By doing so, the capacitor C4 is charged with the voltage Vs+V2+Vsc, which is equal to a voltage difference between −(Vs+V2) and Vsc. When applying the reset erase pulse, in the state where the switch SW4 is turned off, switches SW 2 and SW11 are turned on. In this manner, a current path as shown by a broken line in FIG. 5 is formed, and the voltage of the Y electrode gradually decreases. The voltage of the high potential side terminal VDH of the sub-driver Sn ultimately decreases to the ground GND potential, and correspondingly, the voltage of the low potential side terminal VDL of the sub-driver Sn decreases to the voltage obtained by adding a voltage of the zener diode D5 to −(Vs+V2+Vsc), and this voltage is applied to the Y electrode via the switch SW2. For example, if V2 is 20V, Vs is 90V, Vsc is 0V, and D5 is 15V in the zener diode, the reset erase pulse decreases to −105V.

The final voltage of the reset erase pulse defines the amount of a residual wall charge at the end of the reset period. The voltage by the residual wall charge relates to the voltage applied to each electrode to generate an address discharge, and it is necessary to set the residual wall charge to an appropriate amount in consideration of an operating margin and the like. Hence, the drop voltage of the zener diode is selected so that a desired amount of the residual wall charge can be formed.

Since the switch SW11 is driven by the signal of the ground reference as described above, it is only necessary for the drive circuit 21 thereof to output the signal of the ground reference, and thus the structure thereof becomes simple.

Figure 6:
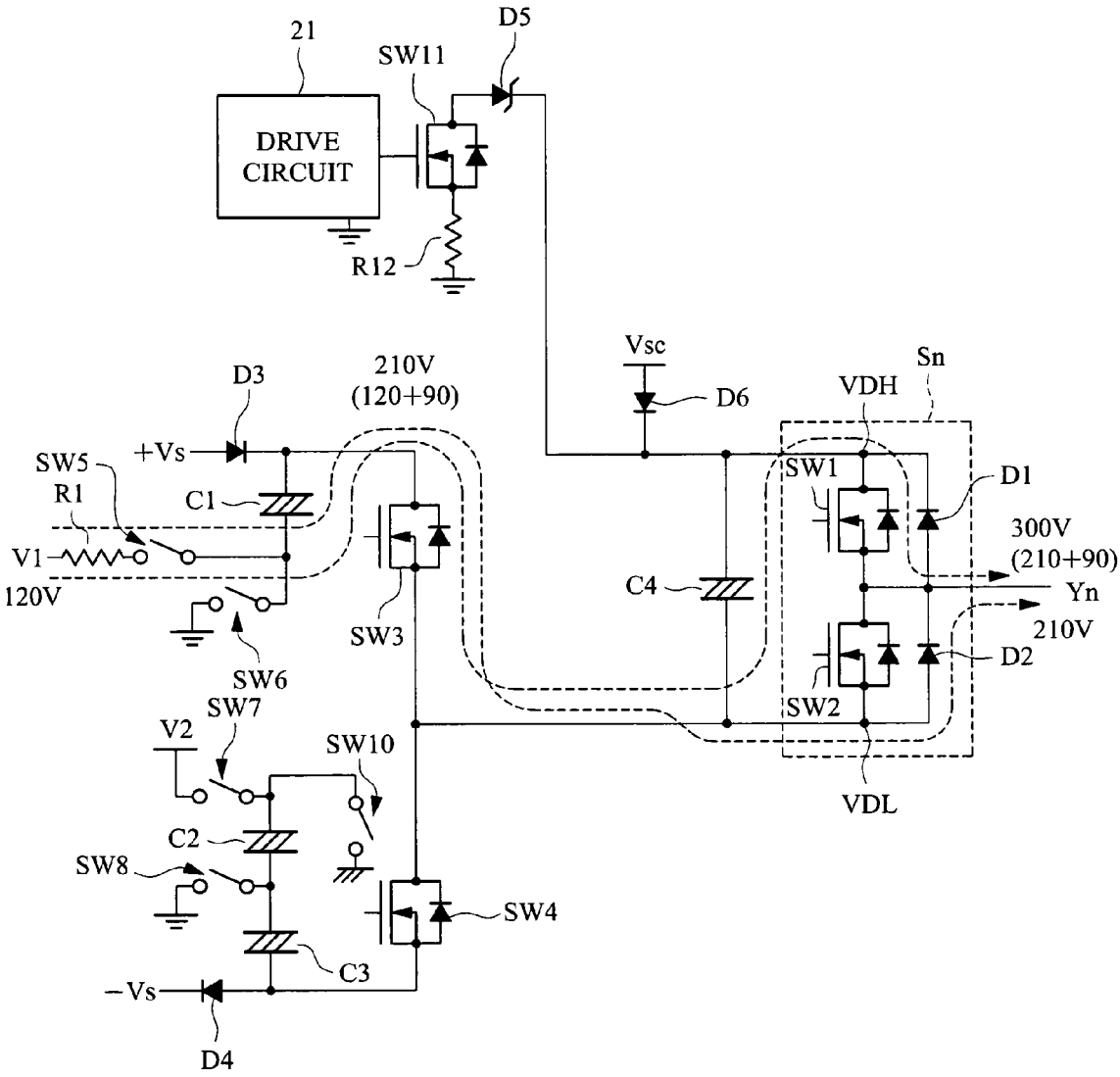
FIG. 6 is a diagram showing a current path in the drive circuit of the embodiment.
Figure 7:
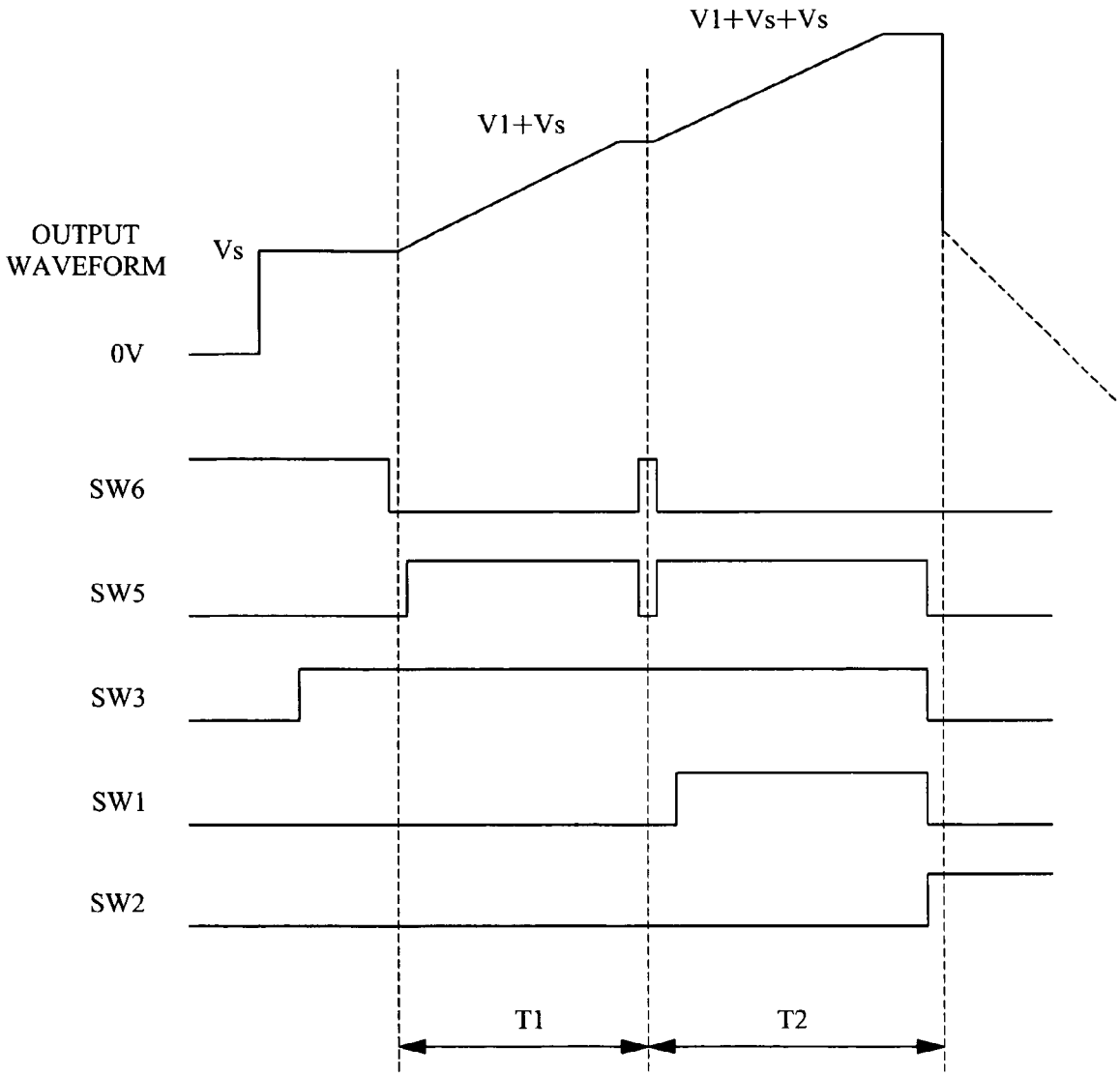
FIG. 7 is a diagram showing an applied voltage waveform and operation of the switches by the drive circuit of the embodiment.

FIG. 6 is a diagram showing the current path in the case of applying a reset write pulse in the Y electrode drive circuit of this embodiment, and FIG. 7 is a diagram showing an output waveform (applied voltage waveform) from the Y electrode drive circuit and the operation of the switches. As shown in FIG. 6, the application of the reset write pulse includes a first step T1 and a second step T2.

The switch SW4 is turned off during the time when the reset write pulse is applied.

First, in the state where the switches SW1, SW2, and SW5 are turned off and the switch SW6 is turned on, the switch SW3 is turned on. By doing so, a voltage +Vs (90V) is applied to the Y electrode via the switch the SW3 and the diode D2.

Next, in the first step T1, the switch SW6 is turned off and the switch SW5 is turned on. Consequently, since the voltage of the terminal of a capacitor C1 changes from the ground GND to V1 (120 V), the voltage of the connecting node between the switch SW3 and the capacitor C1 becomes the voltage V1+Vs (210V) obtained by superposing a voltage V1 (120V) on the voltage +Vs (90V). This voltage V1+Vs is applied to the Y electrode via the switch SW3 and the diode D2. At this time, since the resister R1 is connected between the power supply of the voltage V1 and the switch SW5, the voltage of the Y electrode gradually increases to the voltages V1+Vs (210V).

In the first step T1, when the voltage of the Y electrode increases to V1+Vs, the switch SW5 is once turned off and the switch SW6 is turned on, and thereafter, the switch SW5 is turned on again and the switch SW6 is turned off. By doing so, the capacitor C1 is charged again with the voltage +Vs. At this time, though the voltage of the connecting node between the switch SW3 and the capacitor C1 decreases to the voltage Vs, the output voltage maintains V1+Vs (210V).

In the next second step T2, in the state where the switch SW3 is turned on, the switch SW1 is turned on. Since the voltage of the low potential side terminal VDL of the sub-driver Sn of the capacitor C4 is V1+Vs (210V) and the capacitor C1 is charged with the voltage +Vs (90V), the voltage of the high potential side terminal VDH of the sub-driver Sn of the capacitor C4 is V1+Vs+Vs (300V), and this voltage is applied to the Y electrode via the switch SW1. Also in this case, the voltage gradually increases.

In the foregoing, an embodiment of the present invention has been described. However, the present invention can be applied not only to the PDP device of the embodiment but also to a two-electrode type PDP device or an ALIS PDP device in which all the spaces between the X electrodes and the Y electrodes are used as display lines.

According to the present invention, the cost of the PDP device can be reduced, and since a PDP device can be realized at low cost, it is possible to expand the application range of the PDP device.

What is claimed is:

1. A plasma display device comprising an electrode drive circuit for applying a scan pulse of negative polarity, a sustain pulse, and reset pulses of positive and negative polarities to electrodes of a plasma display panel, wherein said electrode drive circuit comprises:

a scan driver in which a plurality of drivers including first and second switching elements connected in series, a first diode connected in parallel with said first switching element, and a second diode connected in parallel with said second switching element are provided, and a connecting node between a low potential side terminal of said first switching element and a high potential side terminal of said second switching element of each driver is connected to each first electrode;

a capacitor connected between the high potential side terminal of said first switching element and the low potential side terminal of said second switching element;

a voltage supply circuit for selectively supplying plural voltages relating to the voltages of positive and negative polarities of said reset pulse and the voltage of said scan pulse to the low potential side terminal of said second switching element; and a negative reset switch and a resistor connected in series between the high potential side terminal of said first switching element and the around terminal, wherein;

said reset pulse of a negative polarity is applied by turning on said negative reset switch so as to connect the high potential side terminal of said first switching element to the ground terminal in a state where the negative voltage of said reset pulse is charged to said capacitor said voltage supply circuit has a resistor in a path for supplying a low reset voltage, after said capacitor is charged with the negative voltage of said sustain pulse, in a state where said voltage supply circuit supplies a low reset voltage lower than the positive voltage of said reset pulse to the low potential side terminal of said second switching element, said reset pulse of positive polarity is applied in two steps of a first step and a second step, in said first step, said second switching element is turned on and the low reset voltage is applied to said electrodes, and in said second step, after said second switching element is turned off, said first switching element is turned on, and the voltage of said capacitor is superposed on said low reset voltage and then applied to said electrodes.

2. A plasma display device comprising an electrode drive circuit for applying a scan pulse of negative polarity, a sustain pulse, and reset pulses of positive and negative polarities to electrodes of a plasma display panel, wherein said electrode drive circuit comprises:

a scan driver in which a plurality of drivers including first and second switching elements connected in series, a first diode connected in parallel with said first switching element, and a second diode connected in parallel with said second switching element are provided, and a connecting node between a low potential side terminal of said first switching element and a high potential side terminal of said second switching element of each driver is connected to each first electrode;

a capacitor connected between the high potential side terminal of said first switching element and the low potential side terminal of said second switching element; and a voltage supply circuit for selectively supplying plural voltages relating to the voltages of positive and negative polarities of said reset pulse and the voltage of said scan pulse to the low potential side terminal of said second switching element, said voltage supply circuit has a resistor in a path for supplying a low reset voltage, after said capacitor is charged with the negative voltage of said sustain pulse, in a state where said voltage supply circuit supplies a low reset voltage lower than the positive voltage of said reset pulse to the low potential side terminal of said second switching element, said reset pulse of positive polarity is applied in two steps of a first step and a second step, in said first step, said second switching element is turned on and the low reset voltage is applied to said electrodes, and in said second step, after said second switching element is turned off, said first switching element is turned on, and the voltage of said capacitor is superposed on said low reset voltage and then applied to said electrodes.

3. The plasma display device according to claim 1, further comprising:

a constant voltage diode connected between said negative reset switch and the high potential side terminal of said first switching element.

4. The plasma display device according to claim 1, further comprising:

a diode provided between a non-selected voltage which supplies a non-selected voltage applied to said electrodes to which said scan pulse is not applied when said scan pulses are sequentially applied to said electrodes and the high potential side terminal of said first switching element, wherein said non-selected voltage is supplied to said electrodes by turning on said first switching element.

5. The plasma display device according to claim 2, further comprising:

a diode provided between a non-selected voltage which supplies a non-selected voltage applied to said electrodes to which said scan pulse is not applied when said scan pulses are sequentially applied to said electrodes and the high potential side terminal of said first switching element, wherein said non-selected voltage is supplied to said electrodes by turning on said first switching element.

* * * * *